US006638085B1

(12) United States Patent
Martin

(10) Patent No.: US 6,638,085 B1
(45) Date of Patent: Oct. 28, 2003

(54) ELECTRICAL CONNECTOR WITH DUAL RACK MATE ASSIST

(75) Inventor: Galen M. Martin, Camp Hill, PA (US)

(73) Assignee: Tyco Electronics Corp., Middletown, PA (US)

( * ) Notice: Subject to any disclaimer, the term of this patent is extended or adjusted under 35 U.S.C. 154(b) by 0 days.

(21) Appl. No.: 10/142,347

(22) Filed: May 9, 2002

(51) Int. Cl.[7] ..... H01R 13/00
(52) U.S. Cl. ..... 439/157; 439/372
(58) Field of Search ..... 439/157, 372, 439/152

(56) References Cited

U.S. PATENT DOCUMENTS 5,205,752 A * 4/1993 Taguchi et al. ..... 439/157
5,593,309 A 1/1997 Post et al.
5,785,558 A 7/1998 Post et al.
5,833,484 A 11/1998 Post et al.
6,099,330 A 8/2000 Gundermann et al.
6,325,647 B1 12/2001 May et al.

* cited by examiner

*Primary Examiner*—Ross Gushi

(57) ABSTRACT

An electrical connector is provided including first and second housings configured to mate with one another to join corresponding electrical contacts when moved between initial and final positions. The electrical connector includes a lever member engaging and moving the first and second between the initial and final positions as the lever member is rotated about a rotational axis. The lever member includes a cam arm having a pivot post received by the first housing and first and second notches. The first housing includes a post slot for rotatably and slidably retaining the pivot post relative to the rotational axis and a first rack engaging the first notch. The second housing has a second rack engaging the second notch. The first and second racks and notches cooperate to move the first and second housings between the initial and final positions as the lever member is rotated.

30 Claims, 10 Drawing Sheets

ELECTRICAL CONNECTOR WITH DUAL RACK MATE ASSIST

BACKGROUND OF THE INVENTION

Certain embodiments of the present invention generally relate to a lever-based connection assembly for engaging resisting components. More particularly, certain embodiments of the present invention relate to a mate assist assembly for connecting electrical contacts contained in separate housings.

In certain applications, electronic components require a mate assist assembly to electrically connect several electrical contacts. The mate assist assembly includes a first connector housing that holds several electrical contacts, and a second connector housing that holds an equal number of electrical contacts. One connector housing includes male electrical contacts, while the other connector housing includes female electrical contacts. The first connector housing is configured to be received inside the second connector housing. As the number of electrical contacts to be mated increases, it becomes difficult to fully join the mating connector housings because of friction between the mating electrical contacts.

A conventional mate assist assembly includes a lever having a handle and two lever arms that extend from, and are rotated alongside, side walls of the first connector housing. The second connector housing is slid onto and encloses the first connector housing to a point where the electrical contacts resist further insertion. Each lever arm includes a cam arm with notches. Rack teeth are situated within the second connector housing with each rack tooth corresponding to the notches of the cam arms. As the first connector housing is inserted into the second connector housing, the lever is oriented in a fixed position so that the cam arms are aligned to engage the rack teeth.

As the handle is rotated in a first direction, the rack teeth and cam arms engage and pull the first connector housing and lever downward into the second connector housing, mating the electrical contacts. Alternatively, as the handle is rotated in a second direction, the first connector housing is pulled upward out of the second connector housing, unmating the electrical contacts.

The conventional electrical connector suffers from a number of drawbacks. First, the lever member is rotated a large distance before the cam arms engage the rack teeth on the module connector. Therefore, the lever member rotates ninety-degrees to fully connect and disconnect the electrical contacts. Since the lever member rotates ninety-degrees in operation, the lever member is fully upright and parallel to a vertical axis at some point during the course of rotation. When the lever member is in such an upright orientation, the mate assist assembly takes up a large amount of space and is thus limited to use in certain electronic applications where space is not constrained. Therefore, a mate assist assembly is needed having a lever member that rotates a shorter distance to connect the electrical contacts and thus takes up less space during rotation.

Secondly, conventional electrical connectors do not effectively maintain the lever members in the necessary fixed position. For example, some electrical connectors have apertures in the lever arms that receive, and are retained by, deflectable latches extending outward from the side walls of the first connector housing. When the first connector housing is positioned within the second connector housing, the latches are biased inward into the first connector housing to release the lever arms from the fixed position. However, the lever arms must be in a lowered position about the first connector housing for the deflectable latches to engage the apertures. In order to position the first connector housing downward into the second connector housing, the lever is rotated upward to an upright position above the first connector housing. The lever therefore takes up more space and interferes with surrounding components when connecting the electrical contacts, thus limiting the number of components with which the electrical connector is used.

Other electrical connectors maintain the lever in a fixed position with the lever arms extending upright from the first connector housing prior to insertion into the second connector housing so that the lever is rotated downward about the first connector housing to connect the electrical contacts. The lever arms include apertures near the cam arms that receive, and are retained by, protrusions extending out from the side walls of the first connector housing. When the first connector housing is positioned within the second connector housing, the lever is pushed with a force necessary to disengage the apertures from the protrusions to release the lever from the fixed position. However, the protrusions are small and engage only a small amount of surface area of the lever arms. Therefore, when slight forces are applied to the lever, the lever arms are prematurely released from the protrusions such that the lever is no longer in the fixed position. The protrusions also quickly wear down until the protrusions do not engage the lever.

Therefore, a need exists for an electrical connector that overcomes the above problems and addresses other concerns experienced in the prior art.

BRIEF SUMMARY OF THE INVENTION

Certain embodiments of the present invention provide for an electrical connector including first and second housings having ends configured to receive electrical contacts. The first and second housings are configured to be matable with one another to join corresponding electrical contacts and are movable between initial and final positions. The electrical connector also includes a lever member engaging the first and second housings and moving the first and second housings between the initial and final positions as the lever member is rotated through a range of motion about a rotational axis. The lever member includes a cam arm having a pivot post received by the first housing and first and second notches that engage the first and second housings, respectively. The first housing includes a post slot for rotatably and slidably retaining the pivot post relative to the rotational axis. The first housing further has a first rack engaging the first notch, and the second housing has a second rack engaging the second notch. The first and second racks and notches cooperate to move the first and second housings between the initial and final positions as the lever member is rotated along the range of motion.

Figure 1:
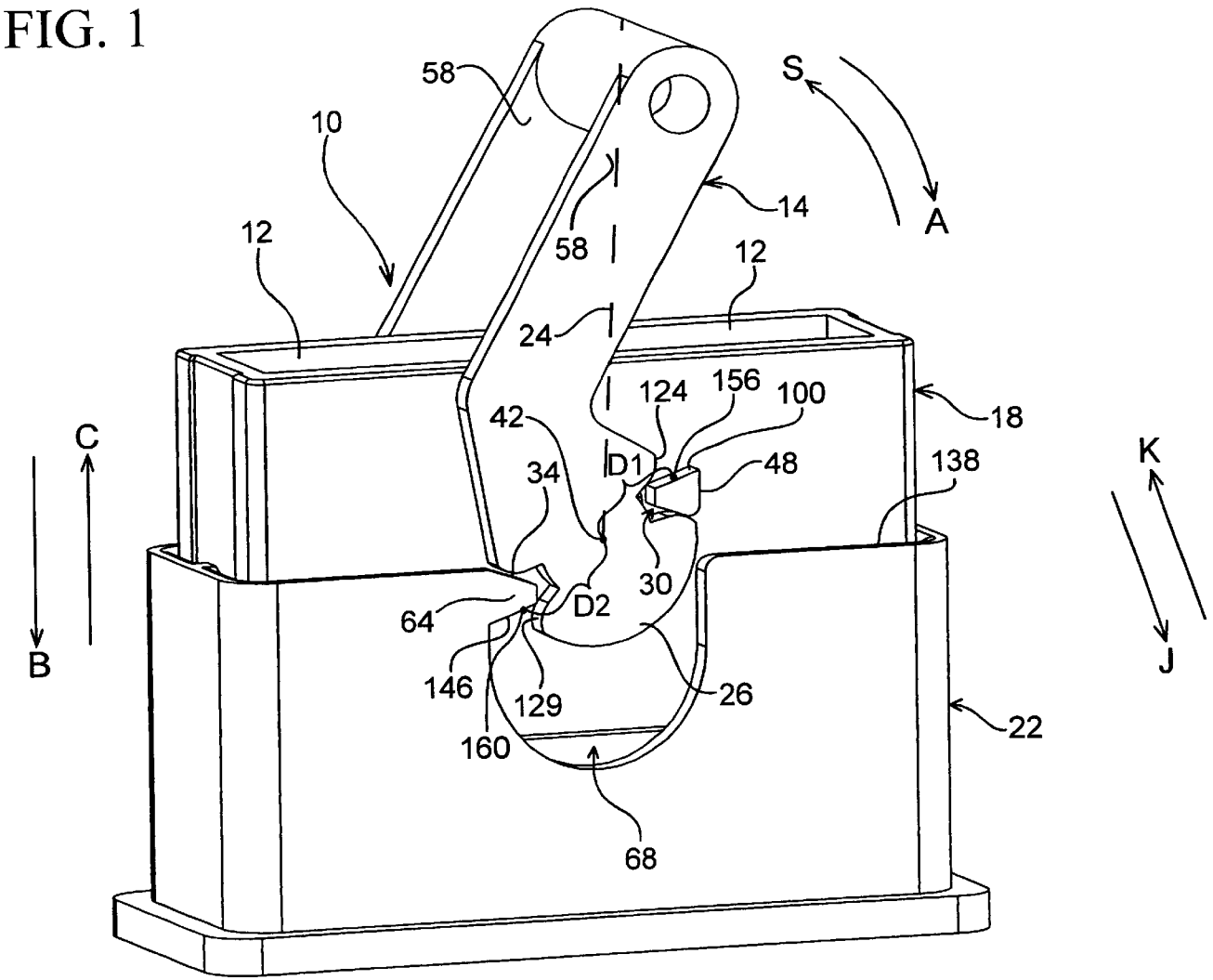
FIG. 1 illustrates a side isometric view of a mate assist assembly according to an embodiment of the present invention.

The foregoing summary, as well as the following detailed description of certain embodiments of the present invention, will be better understood when read in conjunction with the appended drawings. For the purpose of illustrating the invention, there is shown in the drawings, certain embodiments. It should be understood, however, that the present invention is not limited to the arrangements and instrumentality shown in the attached drawings.

DETAILED DESCRIPTION OF THE INVENTION

Figure 8:
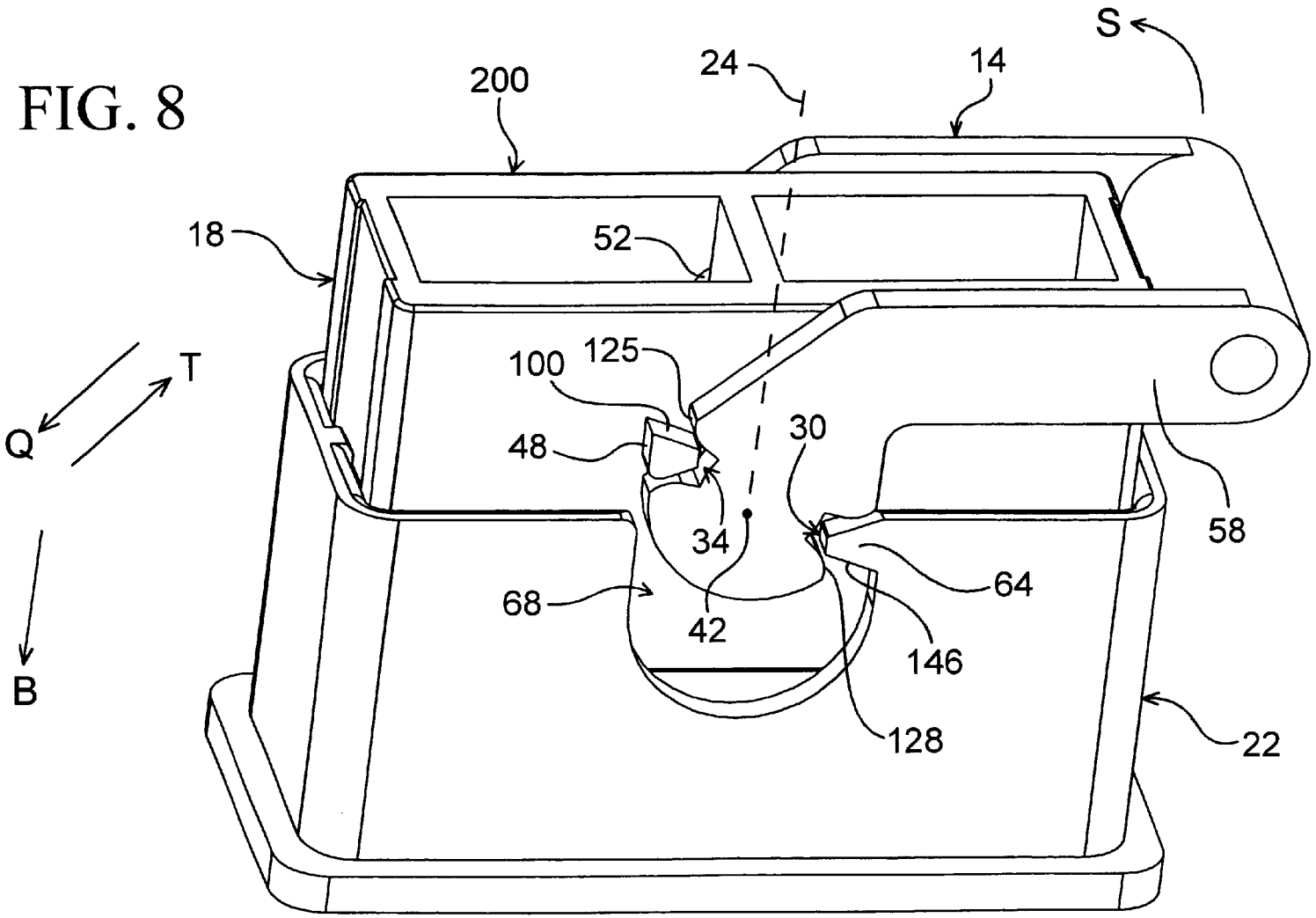
FIG. 8 illustrates a mate assist assembly formed in accordance with an alternative embodiment of the present invention.

FIG. 1 illustrates a side isometric view of a mate assist assembly 10 formed according to an embodiment of the present invention. The mate assist assembly 10 includes a harness connector 18 having contact pockets 12 configured to receive packets that hold groups of electrical contacts (not shown). The mate assist assembly 10 also includes a module connector 22 that holds electrical contacts (not shown) configured to mate with the electrical contacts in the harness connector 18. As shown in FIG. 1, the harness connector 18 is partially inserted within the module connector 22 to an initial staging position. The mate assist assembly 10 also includes a lever member 14 that is retained on the exterior of the harness connector 18 and engages the module connector 22. The lever member 14 is rotatable in the direction of arrow A to move the harness connector 18 from the initial staging position to a final position (FIG. 8). As the lever member 14 is rotated in the direction of arrow A, it pushes the harness connector 18 downward in the direction of arrow B into the module connector 22 until fully mating the electrical contacts of the harness connector 18 and the module connector 22 with each other.

Figure 2:
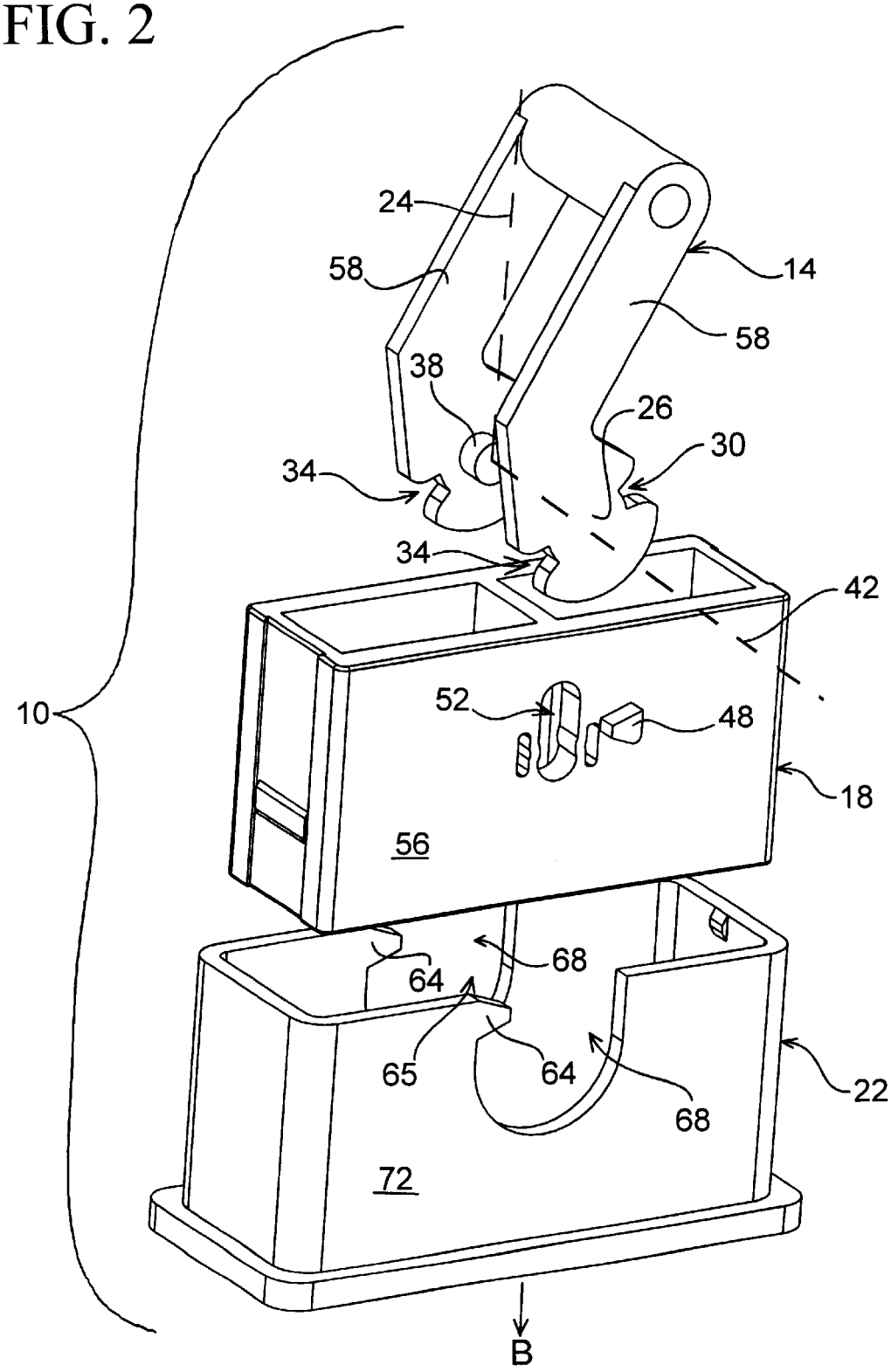
FIG. 2 illustrates an exploded isometric view of the mate assist assembly of FIG. 1.

FIG. 2 illustrates an exploded isometric view of the mate assist assembly 10 of FIG. 1. The lever member 14 includes a pair of spaced apart cam arms 26, each of which has first and second notches 30 and 34 located on opposite sides thereof. The cam arms 26 also include cylindrical pivot posts 38 extending inward from interior surfaces thereof and facing one another. The pivot posts 38 are aligned along a common rotational axis 42. In FIG. 2, the lever member 14 is oriented in an unmated position with lever arms 58 aligned by way of example only, at a thirty-degree angle to a vertical axis 24. The vertical axis 24 extends parallel to the direction of relative motion between the harness connector 18 and module connector 22. The harness connector 18 includes triangular first racks 48 situated beside oval post slots 52 formed through the side walls 56. The module connector 22 includes rectangular side walls 72 having a U-shaped or semi-circular arm catches 68 cut out. Triangular second racks 64 are formed on one side of the arm catches 68 proximate an open face 65 of the module connector 22.

The lever member 14 is removably inserted downward in the direction of arrow B (also referred to as the loading or staging direction) into the harness connector 18 into a fixed position at which the pivot posts 38 are received within the post slots 52 and the first racks 48 are located within the first notches 30 such that the lever arms 58 are aligned generally at a thirty-degree angle to the vertical axis 24. The harness connector 18 and lever member 14 are then slidably inserted in the direction of arrow B into the module connector 22 until reaching the initial staging position shown in FIG. 1. When in the initial staging position, the cam arms 26 are positioned within the arm catches 68 and the second racks 64 are positioned within the second notches 34.

Figure 3:
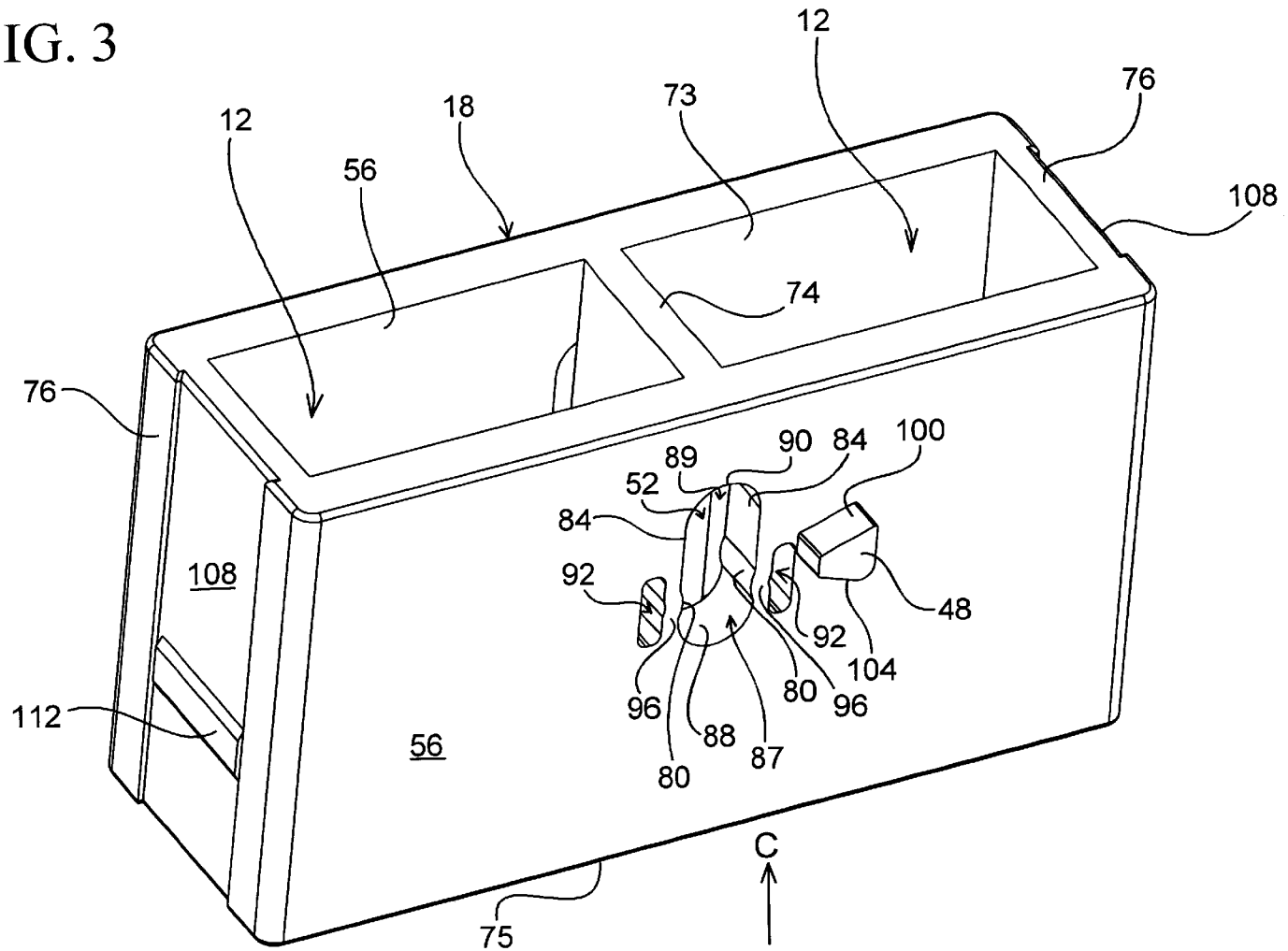
FIG. 3 illustrates an isometric view of a harness connector formed according to an embodiment of the present invention.

FIG. 3 illustrates an isometric view of the harness connector 18 formed according to an embodiment of the present invention. The harness connector 18 is box shaped and includes opposing side walls 56 and opposing end walls 76. By way of example only, a center wall 74 may extend between the side walls 56 to define multiple square contact pockets 12. Electrical contacts (not shown) may be loaded into the contact pockets 12 from either a face 75 or a rear end 73 of the harness connector 18. When the harness connector 18 is slidably inserted into the module connector 22 (FIG. 2), the electrical contacts engage the electrical contacts situated in the module connector 22. An exterior perimeter of the harness connector 18 is smaller than an interior perimeter of the module connector 22, in order that the harness connector 18 may be positioned within the module connector 22.

The post slots 52 are elliptical in shape with interior walls 84, top wall 90, and bottom wall 88, along longitudinal axis extending between the face 75 and rear end 73. The post slots 52 include interior walls 84 having oppositely aligned retention bumps 80 extending inward toward one another. The pivot posts 38 of the cam arms 26 (FIG. 2) are initially retained within a lower position of the post slots 52 between the retention bumps 80 and bottom walls 88 of the post slots 52. The retention bumps 80 permit the pivot posts 38 to rotate freely, while being held in the lower position, until the harness connector 18 is inserted to the initial staging position within the module connector 22 (FIG. 2). As the lever member (FIG. 1) is rotated in the direction of arrow A, the pivot posts 38 are pried upward in the direction of arrow C until squeezing between the retention bumps 80 and moving to an upper position in the post slots 52 between the retention bumps 80 and top wall 90. The pivot posts 38 are free to rotate within the upper position.

The post slots 52 are located between opposed oval flex holes 92. The flex holes 92 extend through the side walls 56 and are oriented with their longitudinal axis aligned parallel to the longitudinal axis of the post slots 52. Narrow flex strips 96 separate the post slots 52 and flex holes 92. As the pivot posts 38 of the cam arms 26 (FIG. 2) are pushed upward in the direction of arrow C from the lower position to the upper position, the pivot posts 38 deflect the retention bumps 80 outward away from each other. The flex strips 96 bow outward in opposite directions into the flex gaps 92, as the retention bumps 80 are deflected away from each other. Once the pivot posts 38 are moved into an upper position 89 above the retention bumps 80, the flex strips 96 spring back toward each other out of the flex gaps 92 such that the retention bumps 80 are returned to an unbiased state underneath the pivot posts 38.

The first racks 48 extend outward opposite each other from the side walls 56 and are located along one side of the post slots 52. The first racks 48 are generally aligned proximate a midpoint of the interior walls 84. Each of the first racks 48 has sloped top and bottom surfaces 100 and 104 that are received within the first notches 30 of the cam arms 26 (FIG. 2) when the lever member 14 (FIG. 2) is mounted on the harness connector 18. The top and bottom surfaces 100 and 104 engage the first notches 30 when the pivot posts 38 are in the lower position 87 in the post slots 52 to hold the lever arms 58 into the fixed position while the harness connector 18 is loaded into the module connector 22 to the initial staging position. As the harness connector 18 is moved from the initial staging position to the final position in the module connector 22, the first racks 48 slide into the arm catches 68 of the module connector 22 (FIG. 2).

The end walls 76 on the harness connector 18 include exterior recessed portions 108 aligned vertically and having retention strips 112 traversing the recessed portions 108 laterally. As the harness connector 18 is slid into the module connector 22 (FIG. 2), the retention strips 112 snapably engage top and bottom retention latches 116 and 118 (FIG. 6) positioned on interior surfaces of end walls 132 of the module connector 22 thereby retaining the harness connector 18.

Figure 4:
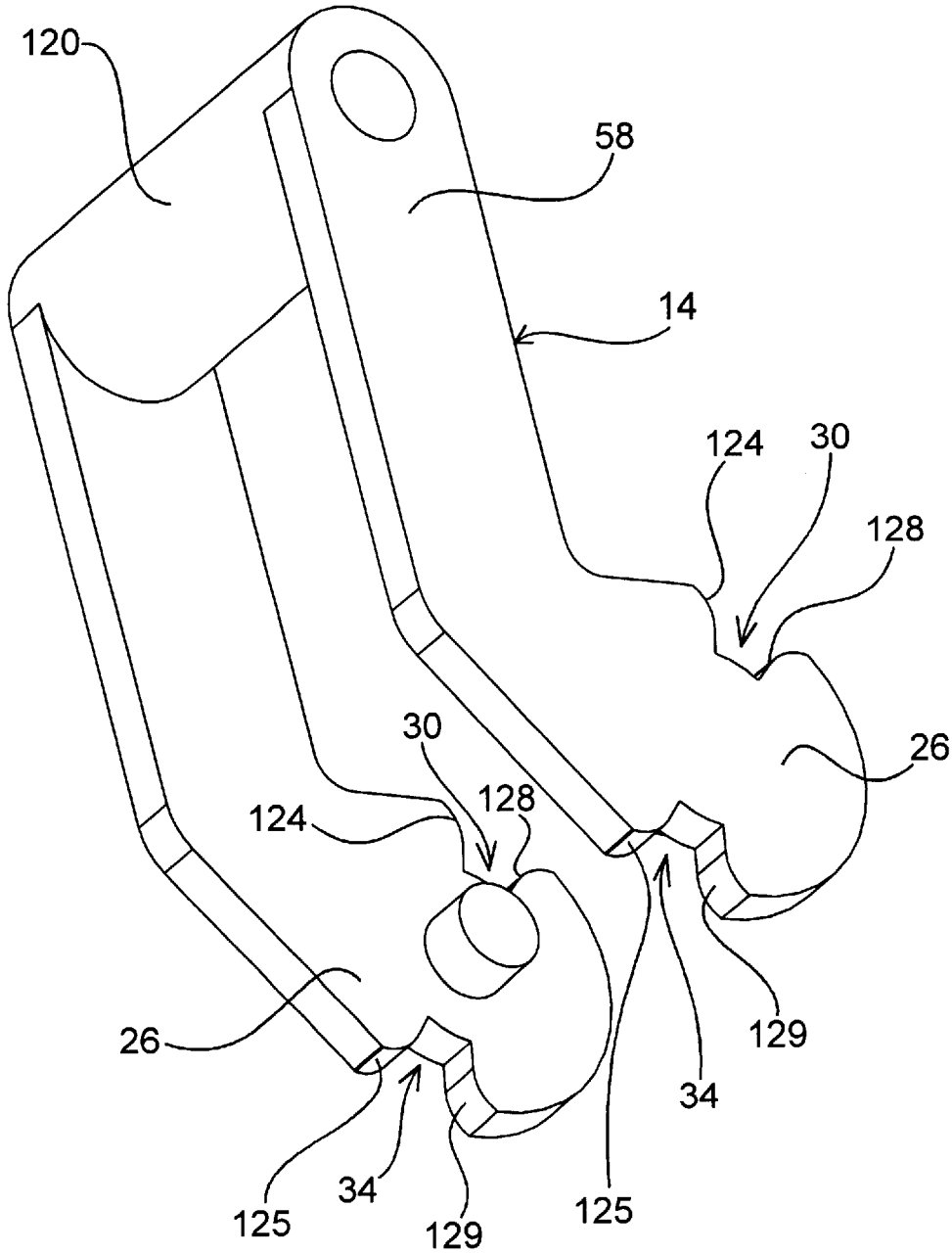
FIG. 4 illustrates an isometric view of a lever member formed according to an embodiment of the present invention.

FIG. 4 illustrates an isometric view of the lever member 14 formed according to an embodiment of the present invention. A handle 120 is formed integral with, and extends perpendicularly between, the lever arms 58, which are in turn formed with the cam arms 26. The first and second notches 30 and 34 within the cam arms 26 have oppositely aligned top and bottom gear surfaces 124 and 128, and 125 and 129, respectively. The first notches 30 engage the first racks 48 of the harness connector 18 (FIG. 3) to retain the lever member 14 in the fixed position prior to insertion into the module connector 22. The first and second notches 30 and 34 engage the first racks 48 on the harness connector 18 and the second racks 64 (FIG. 2) on the module connector 22, respectively, as the lever member 14 is rotated between its initial and final positions.

Figure 5:
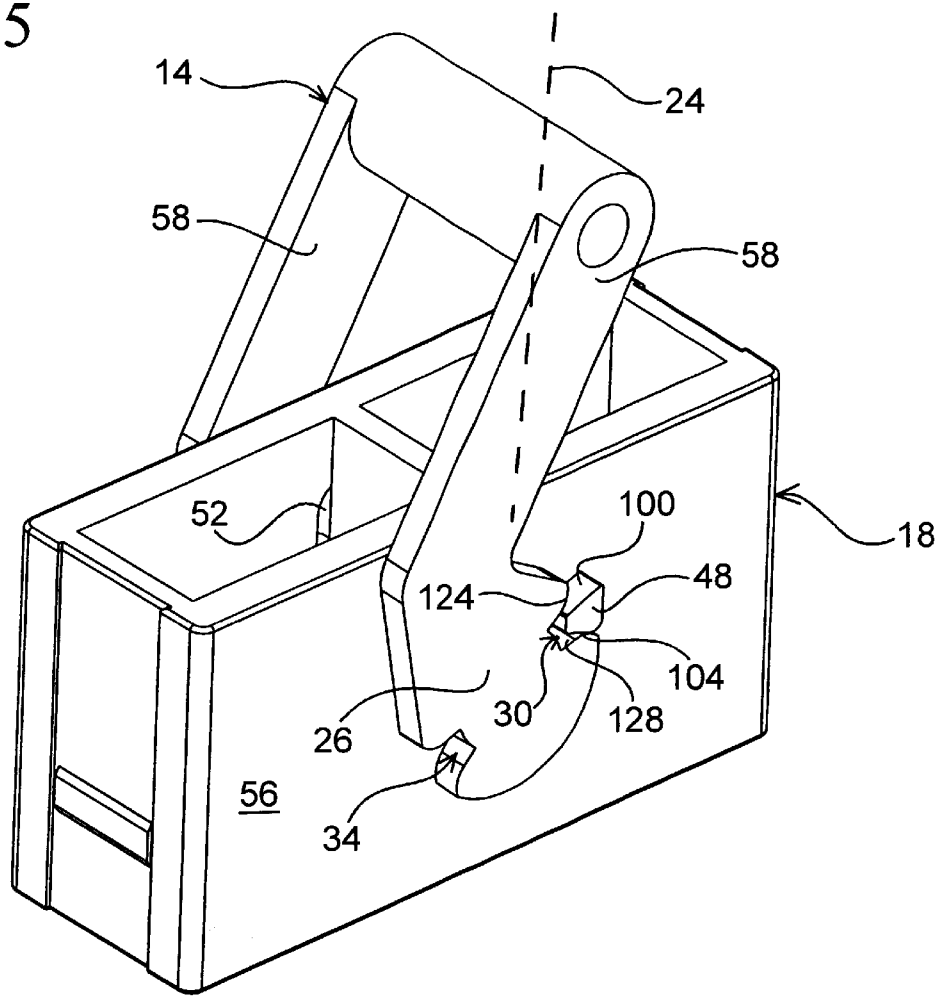
FIG. 5 illustrates an isometric view of the lever member mounted to the harness connector.

FIG. 5 illustrates an isometric view of the lever member 14 mounted to the harness connector 18. The lever member 14 is attached to the harness connector 18 by deflecting the lever arms 58 outward away from each other so that the pivot posts 38 (FIG. 2) slide along the side walls 56 of the harness connector 18 until the pivot posts 38 are enclosed within the post slots 52 between the retention bumps 80 (FIG. 3) and the bottom walls 84 (FIG. 3) and the first notches 30 enclose the first racks 48 of the harness connector 18. The top and bottom gear surfaces 124 and 128 of the first notches 30 resistibly engage the top and bottom surfaces 100 and 104, respectively, of the first racks 48 such that the lever member 14 is maintained in the fixed position with the lever arms 58 generally at a thirty-degree angle to the vertical axis 24.

The post slots 52 help maintain the lever member 14 in the fixed position prior to inserting the harness connector 18 into the module connector 22 (FIG. 2). The retention bumps 80 (FIG. 3) hold the pivot posts 38 (FIG. 2) in the lower position 87 (FIG. 3) within the post slots 52 (FIG. 3), preventing the pivot posts 38 from sliding into the upper position 89 (FIG. 3) within the post slots 52 such that the first notches 30 become disengaged from the first racks 48 and the lever member 14 rotates out of the fixed position. When the lever member 14 is in the fixed position and the harness connector 18 is in the initial staging position within the module connector 22, the cam arms 26 are aligned such that the second notches 34 receive the second racks 64 (FIG. 2) of the module connector 22. The second racks 64 and the second notches 34 are then aligned to engage each other when the lever member 14 is rotated to move the harness connector 18 from the initial staging position to the final position.

Figure 6:
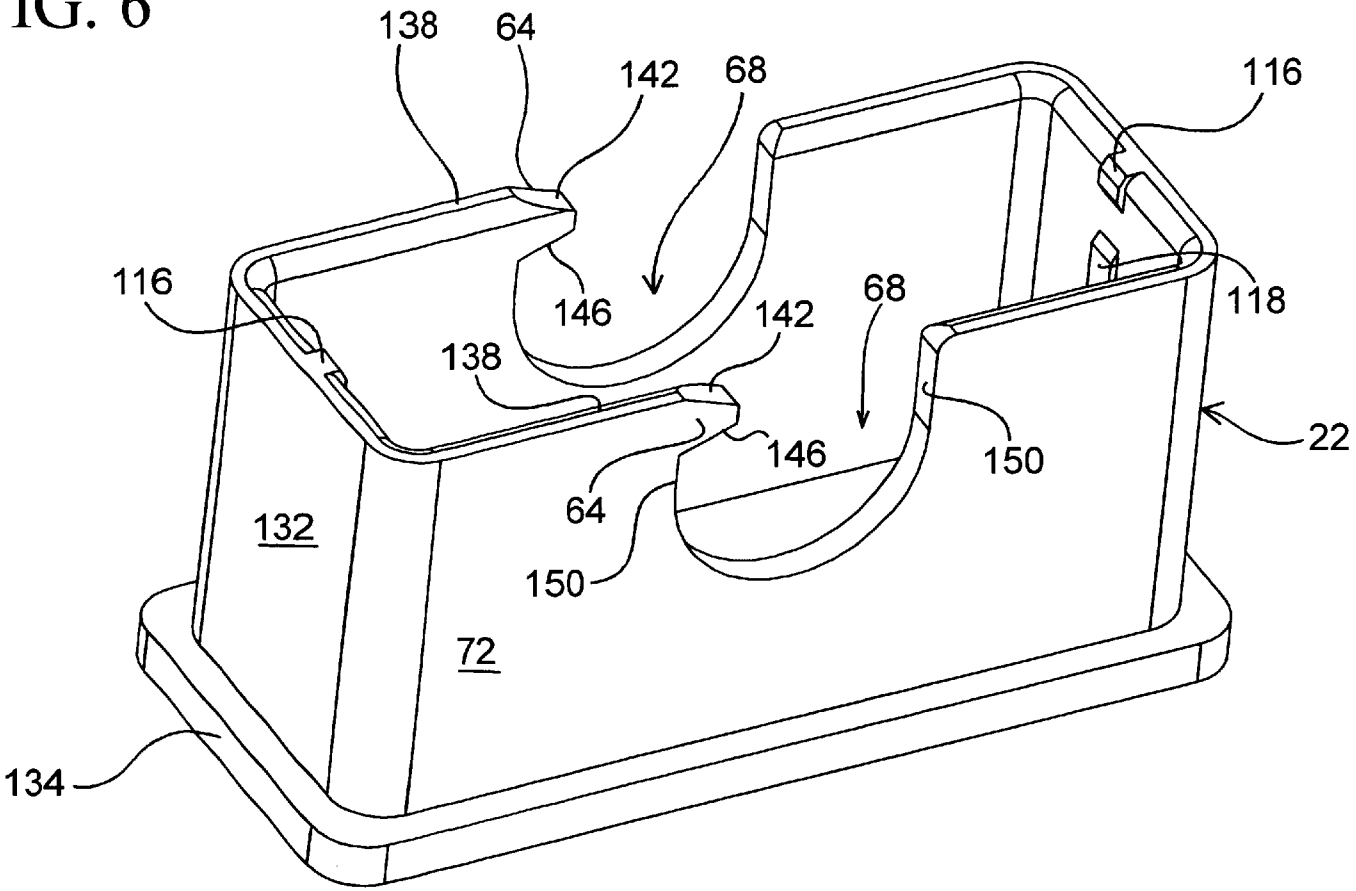
FIG. 6 illustrates an isometric view of a module connector formed according to an embodiment of the present invention.

FIG. 6 illustrates an isometric view of the module connector 22 formed according to an embodiment of the present invention. The side walls 72 are formed integral with, and are aligned perpendicular to, end walls 132. The side and end walls 72 and 132 are formed integral with, and extend from, a base 134, which has a larger perimeter than a perimeter about the side and end walls 72 and 132. The base 134 is mounted to an electronic component (not shown), such as a radio, with the side and end walls 72 and 132 extending outward from the electronic component. The electrical contacts positioned within the module connector 22 are connected to the electronic component through contact slots (not shown). When the harness connector 18 (FIG. 3) is in the final position within the module connector 22, the electrical contacts of the harness and module connectors 18 and 22 are fully mated.

The side walls 72 include the arm catches 68 positioned in the center thereof. The second racks 64 extend into the arm catches 68 at first sides along a top edge 138 of the side walls 72. The second racks 64 have sloped top and bottom surfaces 142 and 146 that engage the second notches 34 on the cam arms 26 (FIG. 4). When the cam arms 26 are rotated to position the harness connector 18 into the final position, the second racks 64 resistibly engage the second notches 34 as described below to pull the harness connector 18 downward into the module connector 22 such that the cam arms 26 and the first racks 48 are positioned within the arm catches 68. The first racks 48 and the second racks 64 are positioned on the harness connector 18 and module connector 22, respectively, such that when the harness connector 18 is in the final position, the first racks 48 and the second racks 64 are located within the arm catches 68 along opposite side walls 150. Thus, the alignment of the first racks 48 and the second racks 64 within the harness connector 18 and the module connector 22, respectively, enable the harness connector 18 to be inserted into the module connector 22 in a correct orientation.

The end walls 132 include the top and bottom retention latches 116 and 118 that snapably engage and retain the retention strips 112 of the harness connector 18 (FIG. 3). As the harness connector 18 is lowered into the module connector 22 into the initial staging position, the retention strips 112 snapably slide over the top retention latches 116 into gaps 122 between the top and bottom retention latches 116 and 118. The top and bottom retention latches 116 and 118 thus retain the retention strips 112 and the harness connector 18 in the initial staging position. As the harness connector 18 is moved from the initial staging position to the final position, the retention strips 112 snapably slide past and under the bottom retention latches 118. When the harness connector 18 is removed from the module connector 22, the retention strips 112 snapably slide back over the bottom and top retention latches 118 and 116.

Returning to FIG. 1, the harness connector 18 is in the initial staging position with the lever member 14 upright in the fixed position. The first racks 48 engage the first notches 30 at a first contact point 156 that is separated from the rotational axis 42 by a pitch radius D1 and the second racks 64 engage the second notches 34 at a second contact point 160 that is separated from the rotational axis 42 by a pitch radius D2. By way of example only, D1 is equal to D2.

To move the harness connector 18 into the final position and mate the electrical contacts, the lever member 14 is rotated about the rotational axis 42 in the direction of arrow A, for example, by approximately sixty degrees until the lever arms 58 rest on the top edges 138 of the module connector 22 perpendicular to the vertical axis 24. As the lever member 14 is rotated in the direction of arrow A, the top gear surfaces 124 of the first notches 30 push against the top surfaces 100 of the first racks 48 in the direction of arrow J and the bottom gear surfaces 129 of the second notches 34 push against the bottom surfaces 146 of the second racks 64 in the direction of arrow K. As the top gear surfaces 124 and the top surfaces 100 engage one another, the bottom gear surfaces 129 of the second notches 34 push against the bottom surfaces 146 of the second racks 64 in the direction of arrow K. The dual contact between the first notches 30 and the first racks 48 and the second notches 34 and the second racks 64 pull the cam arms 26 into the arm catches 68 and thus pull the harness connector 18 into the module connector 22 with enough force to mate the electrical contacts.

Figure 7:
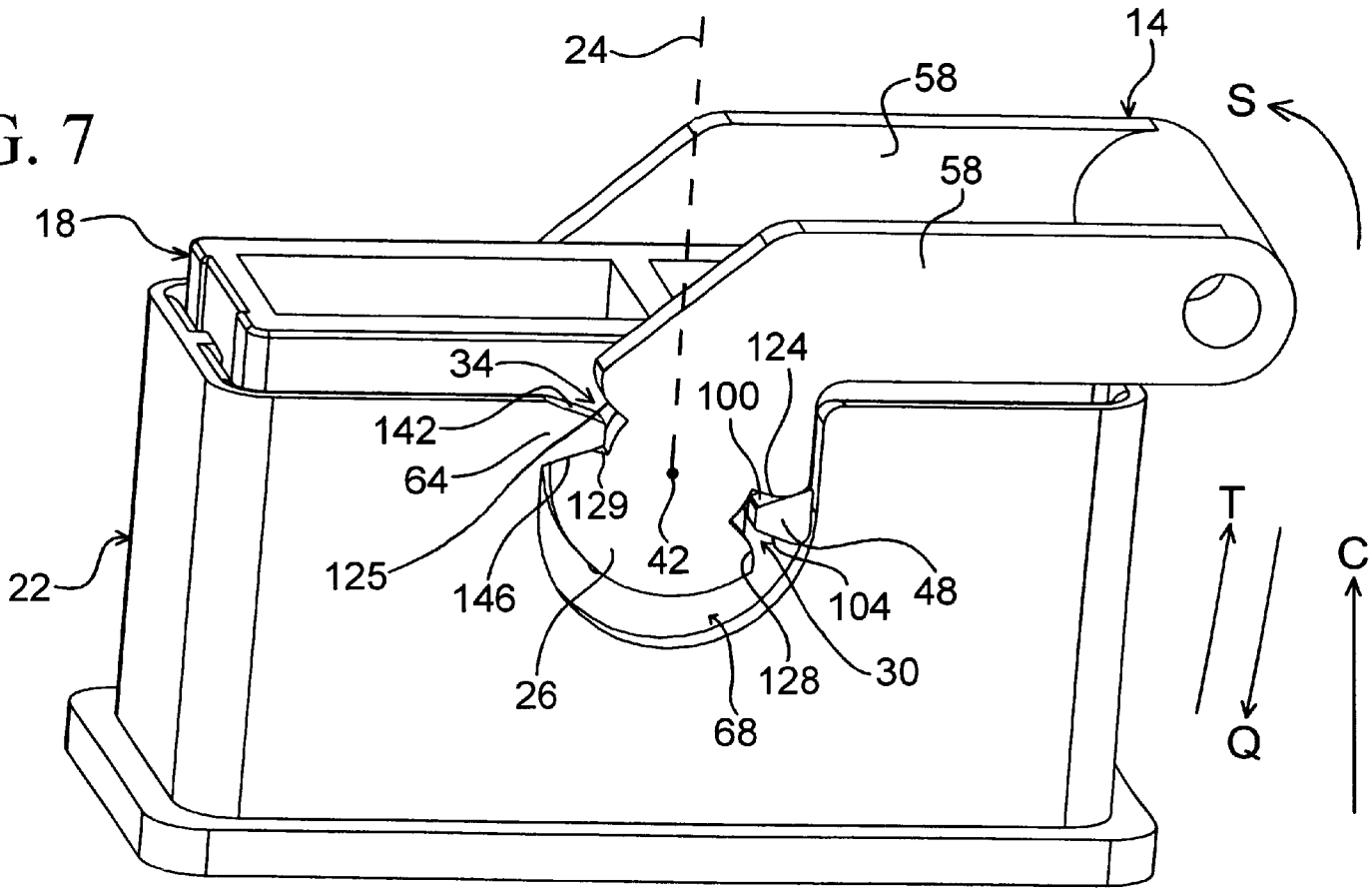
FIG. 7 illustrates a side isometric view of the mate assist assembly in the final position and the electrical contacts fully mated.

FIG. 7 illustrates a side isometric view of the mate assist assembly 10 in the final position with the electrical contacts mated. The cam arms 26 and the first racks 48 are positioned within the arm catches 68 with the top gear surfaces 124 of the first notches 30 against the top surfaces 100 of the first racks 48 and the bottom gear surfaces 129 of the second notches 34 against the bottom surfaces 146 of the second racks 64. The lever arms 58 are aligned perpendicular to the vertical axis 24, but could be oriented to another angle. To disengage the electrical contacts and return the harness connector 18 to the initial staging position, the lever member 14 is rotated in the direction of arrow S about the rotational axis 42. As the lever member 14 is rotated in the direction of arrow S, the bottom gear surfaces 128 of the first notches 30 push against the bottom surfaces 104 of the first racks 48 in the direction of arrow T and the top gear surfaces 125 of the second notches 34 push against the top surfaces 142 of the second racks 64 in the direction of arrow Q. The force exerted between the first and second notches 30 and 34 and the first and second racks 48 and 64, respectively, is sufficient to overcome the static friction of the mated electrical contacts and lift the harness connector 18 upward in the direction of arrow C out of the module connector 22 the initial staging position.

Returning to FIG. 1, when the harness connector 18 is in the initial staging position, the pivot posts 38 (FIG. 2) are in the lower position 87 (FIG. 3) within the post slots 52 (FIG. 3). As the harness connector 18 is moved from the initial staging position to the final position within the module connector 22, the pivot posts 38 rotate about the rotational axis 42 in the lower position 87 (FIG. 3). As the lever member 14 is rotated in the direction of arrow A, the pivot posts 38 slide vertically upward in the direction of arrow C between the rotation bumps 80 (FIG. 3) and into the upper position 89 (FIG. 3). The pivot posts 38 continue to rotate about the rotational axis 42 in the upper position 89 until the harness connector 18 is in the final position.

Alternatively, when the harness connector is moved from the final position to the initial staging position, the pivot posts 38 slide vertically downward in the direction of arrow B from the upper position 89 to the lower position 87 (FIG. 3) when the lever member 14 has been rotated in the direction of arrow S.

Thus, the first racks 48 and the oval shaped post slots 52 (FIG. 3) significantly reduce the distance the lever member 14 is rotated to move the harness connector 18 between the initial and final positions. For example, in FIG. 1, for the harness connector 18 to vertically travel to the final position without the first rack 48, the lever member 14 would have to be rotated a greater distance in the direction of arrow A as the second notches 34 engage the second racks 64 to pull the harness connector 18 into the module connector 22. Additionally, the pivot posts 38 (FIG. 2) sliding vertically within the post slots 52 allow the second racks 64 to maintain the pitch radius D2 such that the second notches 34 closely engage the second racks 64 throughout the course of rotation. By allowing the pivot posts 38 to slide into the upper position 89 (FIG. 3) and thus maintain the pitch radius D2, the second racks 64 remain in resistant contact with the second catches 34 during the course of the rotation such that the first catches 30 push the first racks 48 downward and thus push the harness connector 18 into the final position. Therefore, the first racks 48 and the post slots 52 work together such that the lever member 14 is rotated a reduced distance to move the harness connector 18 the same vertical travel distance to the final position.

Additionally, the pivot post 38 and pivot slot 52 construction may be replaced with other structures that support similar multi-dimensional ranges of motion, such as a bearing and a truck or other multi-dimensional linkage.

Figure 10:
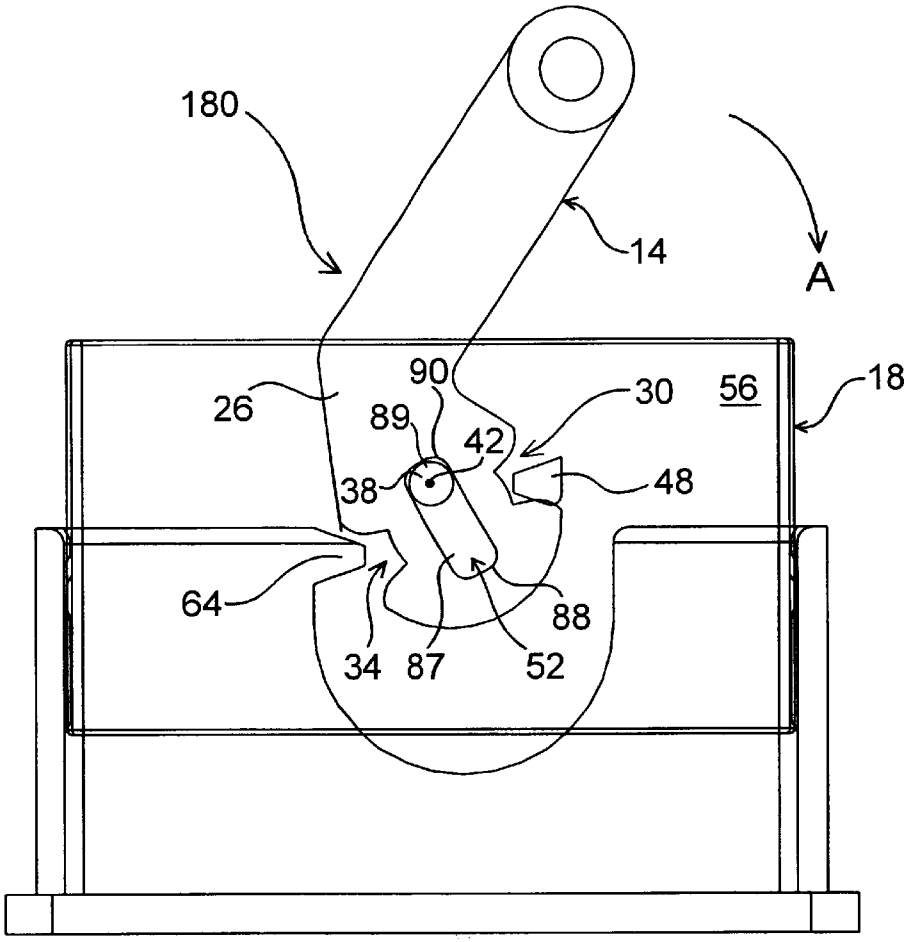
FIG. 10 illustrates a side view of a mate assist assembly formed in accordance with an alternative embodiment of the present invention.

FIG. 10 illustrates a side view of a mate assist assembly 180 formed in accordance with an alternative embodiment of the present invention. The cam arms 26 of the lever member 14 include the post slots 52. The post slots 52 receive the pivot posts 38 extending outward from the side walls 56 of the harness connector 18. When the harness connector 18 is in the initial staging position, the pivot posts 38 are in an upper position 89 engaging the top walls 90 of the post slots 52. As the lever member 14 is rotated about the rotational axis 42 in the direction of arrow A and the first notches 30 and second notches 34 engage the first racks 48 and second racks 64, respectively, the pivot posts 38 slide within the post slots 52 to a lower position 87 engaging the bottom walls 88 of the post slots 52. As in the previous embodiment, the posts slots 52 allow the pivots posts 38 to slide therein such that the second notches 34 remain in contact with the second racks 64. The cam arms 26 of the mate assist assembly 180 may also include the retention bumps 80 and the flex gaps 92 as shown in FIG. 3 to retain the pivot posts 38 in the upper position 89 such that the first notches 30 enclose the first racks 48 to maintain the lever member 14 in the fixed position.

FIG. 8 illustrates a mate assist assembly 200 formed in accordance with an alternative embodiment of the present invention. The mate assist assembly 200 is generally similar to the mate assist assembly 10 of FIG. 1 except the second racks 64 are positioned on the opposite side of the arm catches 68 and the first racks 48 are positioned on the opposite side of the post slots 52. Therefore, when the harness connector 18 is in the initial staging position as shown, the first notches 30 engage the second racks 64 and the second notches 34 engage the first racks 48 such that the lever member 14 is maintained in a fixed position where the lever arms 58 are perpendicular to the vertical axis 24. The lever member 14 is rotated about the rotational axis 42 in the direction of arrow S to move the harness connector 18 into the final position. As the lever member 14 is rotated in the direction of arrow S, the top gear surfaces 125 of the second notches 34 push against the top surfaces 100 of the first racks 48 in the direction of arrow Q and the bottom gear surfaces 128 of the first notches 30 push against the bottom surfaces 146 of the second racks 64 in the direction of arrow T such that the harness connector 18 is pulled downward in the direction of arrow B into the module connector 22.

Figure 9:
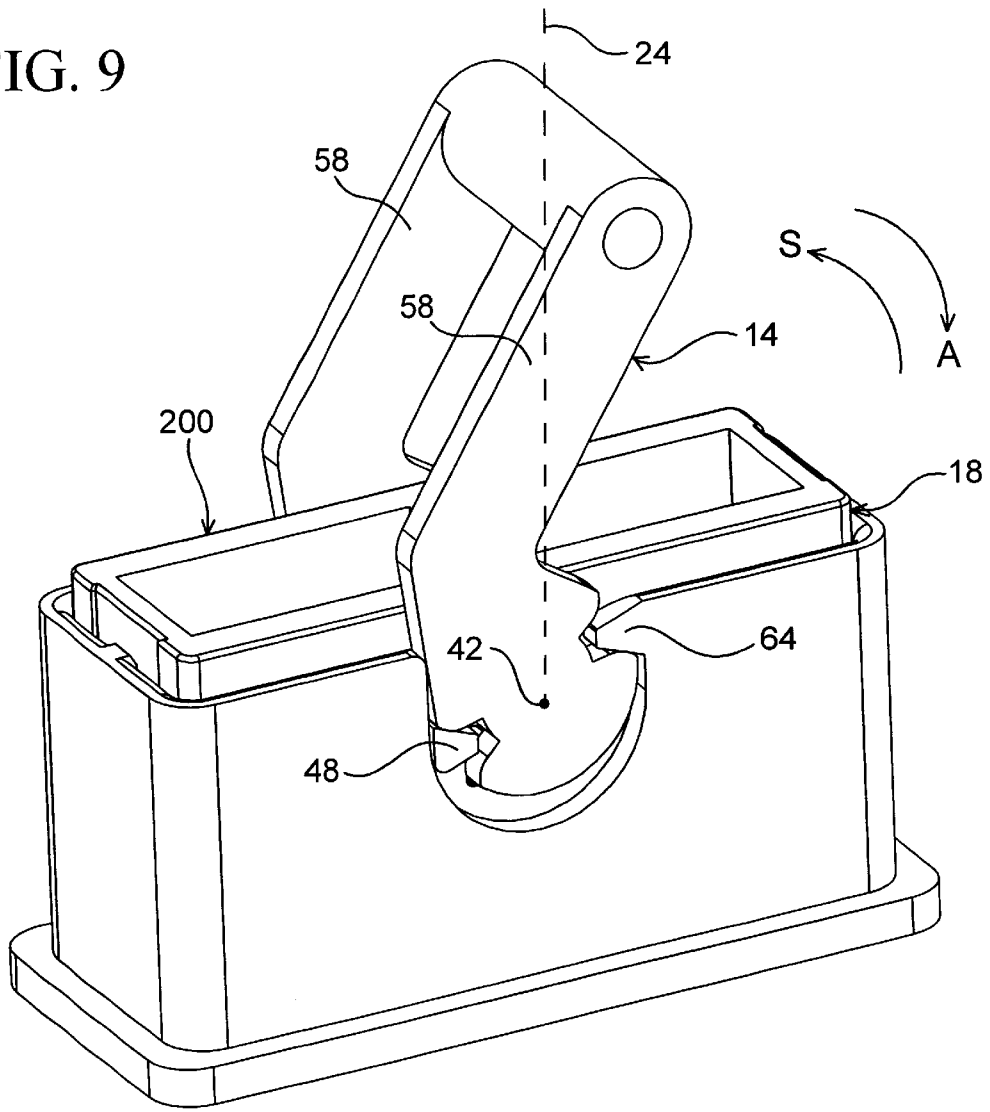
FIG. 9 illustrates a side isometric view of a mate assist assembly of FIG. 8 in the final position.

FIG. 9 illustrates a side isometric view of the mate assist assembly 200 of FIG. 8 in the final position. The lever member 14 has been rotated about the rotational axis 42 in the direction of arrow S such that the lever arms 58 are generally at a thirty-degree angle to the vertical axis 24. To move the harness connector 18 back to the initial staging position, the lever member 14 is rotated about the rotational axis 42 in the direction of arrow A. As in the embodiment of FIG. 1, the first racks 48, post slots 52 (FIG. 3), and the second racks 64 operate to reduce the rotational distance of the lever member 14 to move the harness connector 18 between the initial and final positions. The embodiment in FIGS. 8 and 9 orients the first and second racks 48 and 64 such that the lever member 14 is moved from a position where the lever arms 58 are perpendicular to the vertical axis 24 to a position where the lever arms 58 are at a thirty-degree angle to the vertical axis 24 to connect the electrical contacts.

The mate assist assemblies of the various embodiments confer several benefits. The retention bumps of the post slots hold the pivots posts in the lower position such that the first notches of the cam arms engage the first racks to maintain the lever member in a fixed position prior to the insertion of the harness connector into the module connector. Therefore, the cam arms are properly aligned for the second racks to engage the second notches when the harness connector is in the initial staging position within the module connector.

The first racks are positioned to remain within the first notches as the lever member is rotated such that the first racks fully engage the first notches during the rotation of the lever member as the post slots allow the cam arms to vertically move to maintain contact between the second notches and the second racks. Thus, the lever member rotates half as far to connect the electrical contacts than if no first racks engaged the cam arms and the pivot posts were not allowed to vertically slide within the post slots. Because the lever member rotates a shorter distance to connect the electrical contacts, the mate assist assembly takes up less space and may be used in a wider variety of electronic applications. For example, if the lever member is rotated sixty degrees to connect electrical contacts instead of the ninety degrees required by a typical mate assist assembly, the lever member is only at a thirty-degree angle to the vertical axis when the harness connector in the initial staging position instead of parallel to the vertical axis and thus takes up less space.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. An electrical connector, comprising:

first and second housings having ends configured to receive electrical contacts, said first and second housings being configured to be matable with one another to join corresponding electrical contacts, said first and second housings being movable between initial and final positions;

a lever member engaging said first and second housings and moving said first and second housings between said initial and final positions as said lever member is rotated through a range of motion about a rotational axis, said lever member including a cam arm having a pivot post received by said first housing, said lever member including first and second notches that engage said first and second housings, respectively; and said first housing having a post slot for rotatably and slidably retaining said pivot post relative to said rotational axis, said first housing further having a first rack engaging said first notch, said second housing including an arm catch in a side wall thereof, said second housing having a second rack engaging said second notch, said first and second racks and notches cooperating to move said first and second housings between said initial and final positions as said lever member is rotated along said range of motion.

2. The electrical connector of claim 1, wherein said post slot has an oval shape with at least one retention bump along an interior surface thereof that separates upper and lower positions within said post slot, said retention bump frictionally engaging said pivot post to retain said pivot post in said lower position while said lever member moves through a portion of said range of motion.

3. The electrical connector of claim 1, wherein said post slot has retention bumps oriented opposite each other along interior surfaces and said first housing has flex gaps situated on opposite sides of said post slot such that flex strips extend between said post slot and said flex gaps, said flex gaps receiving said flex strips as said retention bumps are pushed laterally outward by said pivot post as said pivot post slides vertically upward within said post slot along a vertical axis above said retention bumps.

4. The electrical connector of claim 1, wherein said first notch has top and bottom gear surfaces and said first rack has top and bottom surfaces, said top gear surface engaging said top surface as said lever member is rotated through said range of motion to move said first and second housings from said initial position to said final position, and said bottom gear surface engaging said bottom rack surface as said lever member is rotated through said range of motion to move said first and second housings from said final position to said initial position.

5. The electrical connector of claim 1, wherein said second notch has top and bottom gear surfaces and said second rack has top and bottom surfaces, said bottom gear surface engaging said bottom surface as said lever member is rotated through said range of motion to move said first and second housings from said initial position to said final position, and said top gear surface engaging said top surface as said lever member is rotated through said range of motion to move said first and second housings from said final position to said initial position.

6. The electrical connector of claim 1, wherein said pivot post slides vertically upward within said post slot along a vertical axis perpendicular to said rotational axis about which said pivot post rotates as said first and second housings are moved from said initial position to said final position.

7. The electrical connector of claim 1, wherein said pivot post slides along a linear path within said post slot in a direction perpendicular to said rotational axis about which said pivot post rotates as said first and second housings are moved between said final position and said initial position.

8. The electrical connector of claim 1, wherein said arm catch is semi-circular and from an interior surface of which said second rack extends, said arm catch receives said cam arm and said first rack as said first and second housings are moved from said initial position to said final position such that said second notch remains in contact with said second rack.

9. The electrical connector of claim 1, wherein said pivot slot permits rotation of said pivot post about said rotational axis and permits linear movement of said pivot post transverse to said rotational axis.

10. The electrical connector of claim 1, wherein said pivot post and pivot slot cooperate to permit linear motion between said lever member and said first housing and linear motion between said lever member and said second housing.

11. The electrical connector of claim 1, further comprising a multidimensional linkage operating in first and second rotational positions with respect to said first housing, said first and second rotational positions having corresponding first and second rotational axes, said multidimensional linkage rotating during first and second portions of said range of motion about said first and second rotational axes, respectively.

12. The electrical connector of claim 1, further comprising a multidimensional linkage operating in first and second rotational positions with respect to said first housing, said first-and second rotational positions having corresponding first and second rotational axes, said first and second rotational axes being parallel to one another and separated from one another along a linear path.

13. An electrical connector comprising:

first and second housings having ends configured to receive electrical contacts, said first and second housings being configured to be matable with one another to join corresponding electrical contacts, said first and second housings being movable between initial and final positions;

a lever member having a cam arm that engages said first and second housings and moves said first and second housings between said initial and final positions as said lever member is rotated through a range of motion about a rotational axis and along a linear path, said second housing including an arm catch in a side wall thereof; and a multidimensional linkage interconnecting said lever member and said first housing and permitting said lever member to rotate about said rotational axis and along said linear path relative to said first housing when moving said first and second housings between said initial and final positions as said lever member is rotated through said range of motion.

14. The electric connector of claim 13, wherein said lever member includes multiple cam arms that engage first and second racks on said first and second housings, respectively, as said lever member is rotated through said range of motion.

15. The electric connector of claim 13, wherein said cam arm has first and second notches, said first notch engaging a first rack on said first housing and said second notch engaging a second rack on said second housing as said lever member is rotated through said range of motion.

16. The electrical connector of claim 13, wherein said multidimensional linkage includes a pivot post and a post slot, said pivot post sliding vertically upward within said post slot along a vertical axis perpendicular to said rotational axis about which said pivot post rotates as said first and second housings are moved from said initial position to said final position.

17. The electrical connector of claim 13, wherein said multidimensional linkage includes a pivot post and a post slot, said pivot post sliding along a linear path within said post slot in a direction perpendicular to said rotational axis about which said pivot post rotates as said first and second housings are moved between said final position and said initial position.

18. The electrical connector of claim 13, wherein said multidimensional linkage operates in first and second rotational positions with respect to said first housing, said first and second rotational positions having corresponding first and second rotational axes, said multidimensional linkage rotating during first and second portions of said range of motion about said first and second rotational axes, respectively.

19. The electrical connector of claim 13, wherein said multidimensional linkage operates in first and second rotational positions with respect to said first housing, said first and second rotational positions having corresponding first and second rotational axes, said first and second rotational axes being parallel to one another and separated from one another along said linear path.

20. The electrical connector of claim 13, wherein said multidimensional linkage includes a pivot post and a post slot, said post slot having retention humps oriented opposite each other along interior surfaces, said retention humps frictionally engaging said pivot post to retain said pivot post in a first position between said retention bumps and bottom surfaces of said post slot such that said cam arm contacts a first rack on said first housing to hold said lever member in a fixed position as said first housing is inserted into said second housing.

21. The electrical connector of claim 13, wherein said multidimensional linkage includes a pivot post and a post slot, said post slot having retention bumps oriented opposite each other along interior surfaces and flex gaps situated on opposite sides of said post slot such that flex strips extend between said post slot and said flex gaps, said flex gaps receiving said flex strips as said retention bumps are pushed laterally outward by said pivot post as said pivot post slides vertically within said post slot along a vertical axis.

22. The electrical connector of claim 13, wherein said multidimensional linkage includes a pivot post and a post slot, said pivot post sliding vertically within said post slot along a vertical axis as said first and second housings are moved between said initial position and said final position, said cam arm remaining in contact with a second rack on said second housing as said pivot post slides vertically within said post slot.

23. The electrical connector of claim 13, wherein said arm catch is semi-circular and from an interior surface of which said second rack extends, said arm catch receives said cam arm and said first rack as said first and second housings are moved from said initial position to said final position such that said cam arm remains in contact with said second rack.

24. An electrical connector comprising:

first and second housings having ends configured to receive electrical contacts, said first and second housings being configured to be matable with one another to join corresponding electrical contacts, said first and second housings being movable between initial and final positions, said first and second housings having first and second racks, respectively; and a lever member rotatably connected to said first housing having a cam arm that engages said first and second racks and moves said first and second housings between said initial and final positions as said lever member is rotated through a range of motion about a rotational axis, said first and second racks being spaced radially apart from said rotational axis, said second housing including an arm catch in a side wall thereof.

25. The electrical connector of claim 24, wherein said cam arm has first and second notches, said first notch engaging said first rack on said first housing and said second notch engaging said second rack on said second housing as said lever member is rotated through said range of notion.

26. The electrical connector of claim 24, wherein one of said first housing and said lever member includes a pivot post and another of said first housing and said lever member includes a post slot, said pivot post sliding vertically upward within said post slot along a vertical axis perpendicular to said rotational axis about which said pivot post rotates as said first and second housings are moved from said initial position to said final position.

27. The electrical connector of claim 24, wherein one of said first housing and said lever member includes a pivot post and another of said first housing and said lever member includes a post slot, said pivot post sliding along a linear path within said post slot in a direction perpendicular to said rotational axis about which said pivot post rotates as said first and second housings are moved between said final position and said initial position.

28. The electrical connector of claim 24, wherein said cam arm includes a first notch having top and bottom gear surfaces and said first rack has top and bottom surfaces, said top gear surface engaging said top surface as said lever member is rotated through said range of motion to move said first and second housings from said initial position to said final position, and said bottom gear surface engaging said bottom surface as said lever member is rotated through said range of motion to move said first and second housings from said final position to said initial position.

29. The electrical connector of claim 24, wherein said cam arm includes a second notch having top and bottom gear surfaces and said second rack has top and bottom surfaces, said bottom gear surface engaging said bottom surface as said lever member is rotated through said range of motion to move said first and second housings from said initial position to said final position, and said top gear surface engaging said top surface as said lever member is rotated through said range of motion to move said first and second housings from said final position to said initial position.

30. The electrical connector of claim 24, wherein one of said first housing and said lever member includes a pivot post and another of said first housing and said lever member includes a post slot, said post slot having an oval shape with at least one retention bump along an interior surface thereof that separates upper and lower positions within said post slot, said retention bump frictionally engaging said pivot post to retain said pivot post in said lower position while said lever member moves through a portion of said range of motion.

* * * * *